US011798726B2

(12) United States Patent
Yazawa et al.

(10) Patent No.: US 11,798,726 B2
(45) Date of Patent: Oct. 24, 2023

(54) COIL COMPONENT, CIRCUIT SUBSTRATE, AND ELECTRONIC DEVICE

(71) Applicant: TAIYO YUDEN CO., LTD., Tokyo (JP)

(72) Inventors: Kenji Yazawa, Tokyo (JP); Atsushi Shimamura, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 464 days.

(21) Appl. No.: 17/027,174

(22) Filed: Sep. 21, 2020

(65) Prior Publication Data

US 2021/0098176 A1 Apr. 1, 2021

(30) Foreign Application Priority Data

Sep. 27, 2019 (JP) ..... 2019-178002

(51) Int. Cl.

| | |
|---|---|
| ***H01F 27/255*** | (2006.01) |
| ***H01F 1/34*** | (2006.01) |
| ***H01F 27/28*** | (2006.01) |
| ***H01F 41/02*** | (2006.01) |

(52) U.S. Cl.

CPC ..... *H01F 27/255* (2013.01); *H01F 1/344* (2013.01); *H01F 27/28* (2013.01); *H01F 41/0246* (2013.01)

(58) Field of Classification Search

None

See application file for complete search history.

(56) References Cited

U.S. PATENT DOCUMENTS

2015/0097137 A1* 4/2015 Wada ..... C04B 35/62645 252/62.6
2020/0176157 A1* 6/2020 Kitadai ..... H01F 1/36

FOREIGN PATENT DOCUMENTS

| | | | |
|---|---|---|---|
| JP | H01-103953 | A | 4/1989 |
| JP | H01-228108 | A | 9/1989 |
| JP | H04-325458 | A | 11/1992 |
| JP | H011-35369 | A | 2/1999 |
| JP | 2020-088266 | A | 6/2020 |

OTHER PUBLICATIONS

Notice of Reasons for Refusal dated Jul. 4, 2023, issued in corresponding Japanese Patent Application No. 2019-178002, with English translation (5 pgs.).

* cited by examiner

*Primary Examiner* — Kevin M Bernatz
(74) *Attorney, Agent, or Firm* — Pillsbury Winthrop Shaw Pittman, LLP

(57) ABSTRACT

A coil component according to one embodiment of the invention includes a core and a winding wound around the core. The core includes a plurality of ferrite crystal grains and a plurality of Bi segregated regions situated at a grain boundary of the plurality of ferrite crystal grains. In one embodiment, a plurality of line profiles obtained by detecting the content of Bi along a plurality of scanning lines intersecting with the grain boundary include at least one first line profile that has a detection peak of Bi at the grain boundary and two or more second line profiles that have no detection peak of Bi.

7 Claims, 10 Drawing Sheets

COIL COMPONENT, CIRCUIT SUBSTRATE, AND ELECTRONIC DEVICE

CROSS-REFERENCE TO RELATED APPLICATIONS

This application is based on and claims the benefit of priority from Japanese Patent Application Serial No. 2019-178002 (filed on Sep. 27, 2019), the contents of which are hereby incorporated by reference in its entirety.

TECHNICAL FIELD

The present disclosure relates to a coil component, a circuit substrate, and an electronic device.

BACKGROUND

Various coil components are used in electronic devices. Examples of the coil components include an inductor and a transformer used to remove noise from a signal. As one type of coil components, a wire-wound coil component is known. A wire-wound coil includes a core which is a sintered body of ferrite material, a winding wound around the core, and a plurality of external electrodes electrically connected to ends of the winding. In a reflow process performed when such a coil component is mounted on a circuit substrate, a crack may sometime occur in the core due to thermal shock.

In order to prevent the occurrence of cracks in the ferrite core due to thermal shock, it has been proposed that the core include a subcomponent containing Bi (bismuth). For example, Japanese Patent Application Publication No. Hei. 4-325458 ("the '458 Publication") discloses a ferrite material containing 0.03 to 2 wt % of $Bi_2O_3$ as a subcomponent relative to the main component. In a ferrite sintered body formed of the ferrite material disclosed in the '458 Publication, an amorphous layer of the subcomponent and impurities with a thickness of 2 to 50 nm is formed at grain boundaries of ferrite crystal. The '458 Publication reports that a sintered ferrite having excellent thermal shock resistance can be obtained by providing the amorphous layer at the grain boundaries.

Japanese Patent Application Publication No. 11-35369 ("the '369 Publication") discloses a ferrite material that includes, relative to the main component, 0.05 to 2.0 wt % of bismuth oxide ($Bi_2O_3$), 0.05 to 1.0 wt % of silicon dioxide ($SiO_2$), and 0.05 to 1.5 wt % of chromium oxide ($Cr_2O_3$). The '369 Publication describes that a glassy stress relaxation layer containing these subcomponents is formed at grain boundaries of ferrite particles and the stress relaxation layer can stop development of cracks. Therefore it is possible to obtain sintered ferrite that has an excellent thermal shock resistance.

Japanese Patent Application Publication No. Hei. 1-228108 ("the '108 Publication") discloses a Ni—Cu—Zn based ferrite material containing 0.03 wt % or less of $SiO_2$, 0.10 wt % or less of MnO, 0.10 wt % or less (not including 0) of $Bi_2O_3$, and 1.0 wt % or less (not including 0) of MgO as subcomponents. A sintered body of the ferrite material of the '108 Publication has a stress relaxation layer composed of subcomponents at the grain boundary of crystal grains. The '108 Publication said that the stress relaxation layer contributes to improve the material strength of the sintered ferrite because stress is relaxed when the stress is applied to the sintered ferrite from the outside.

As described above, a ferrite material containing Bi oxide as the subcomponent has been conventionally used to form a film containing Bi between crystal grains in the sintered ferrite body in order to prevent generation and expansion of cracks caused by external stress with this film.

However, in the ferrite core in which the stress relaxation layer containing Bi oxide is formed at the grain boundaries, the crystals are bonded to each other via the soft stress relaxation layer. Therefore, the ferrite core in which the stress relaxation layer containing Bi oxide is formed at the grain boundaries has lower mechanical strength against external force than a ferrite core having no stress relaxation layer.

SUMMARY

One object of the present invention is to overcome or mitigate the above drawback. In particular, one object of the invention is to provide a coil component having a ferrite core capable of preventing the occurrence of cracks due to thermal shock and having improved mechanical strength against external force. Other objects of the present invention will be made apparent through the entire description in the specification.

A coil component according to one aspect of the invention includes a core and a winding wound around the core. The core includes a plurality of ferrite crystal grains and a plurality of Bi segregated regions situated at a grain boundary of the plurality of ferrite crystal grains. In the above coil component, a plurality of line profiles obtained by detecting the content of Bi along a plurality of scanning lines intersecting with the grain boundary include at least one first line profile that has a detection peak of Bi at the grain boundary and two or more second line profiles that have no detection peak of Bi.

In the above coil component, the plurality of scanning lines may include at least one first scanning line corresponding to the at least one first line profile and two second scanning lines corresponding to the two or more second line profiles, and at least one of the at least one first scanning line may be disposed between the two second scanning lines.

In the above coil component, the plurality of scanning lines may be set at equal intervals.

In the above coil component, the core may contain 0.03 to 0.1 wt % of Bi in terms of oxide.

In the above coil component, the core may contain 0.05 to 0.075 wt % of Bi in terms of oxide.

A coil component according to another aspect of the invention includes a core and a winding wound around the core. The core includes a plurality of ferrite crystal grains and a plurality of Bi segregated regions situated at a grain boundary of the plurality of ferrite crystal grains. The plurality of Bi segregated regions are separated from each other.

A circuit substrate according to yet another aspect of the invention includes the above coil component.

An electronic device according to still yet another aspect of the invention includes the above circuit substrate.

According to various embodiments of the invention disclosed herein provide a coil component having a ferrite core capable of preventing the occurrence of cracks due to thermal shock and having improved mechanical strength against external force.

DESCRIPTION OF THE EMBODIMENTS

Figure 1:
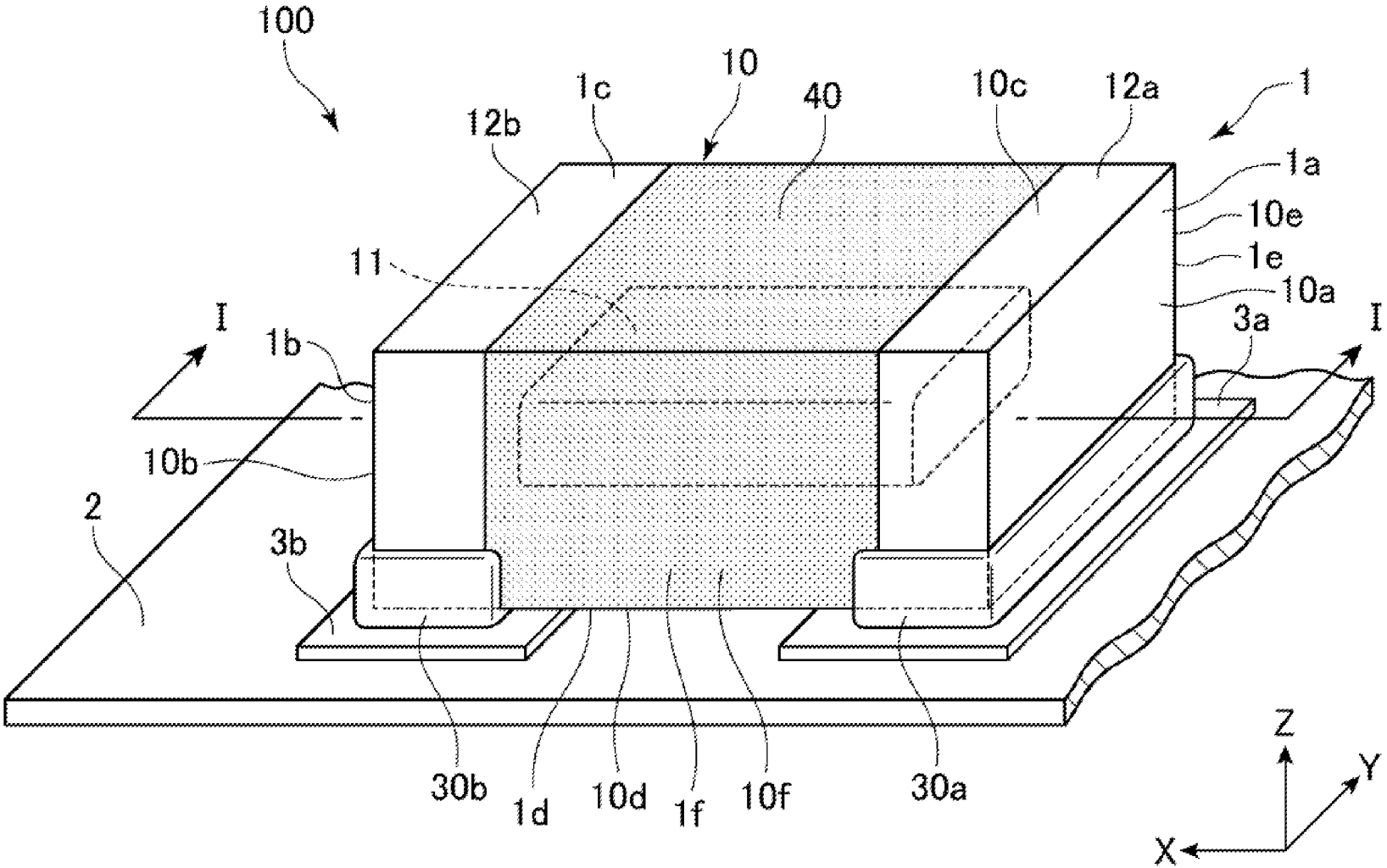
FIG. 1 is a perspective view of a coil component according to one embodiment of the invention.

Various embodiments of the present invention will be hereinafter described with reference to the accompanying drawings. Elements common to a plurality of drawings are denoted by the same reference signs throughout the plurality of drawings. It should be noted that components in the drawings are not necessarily drawn to scale for the sake of convenience of description.

Figure 2:
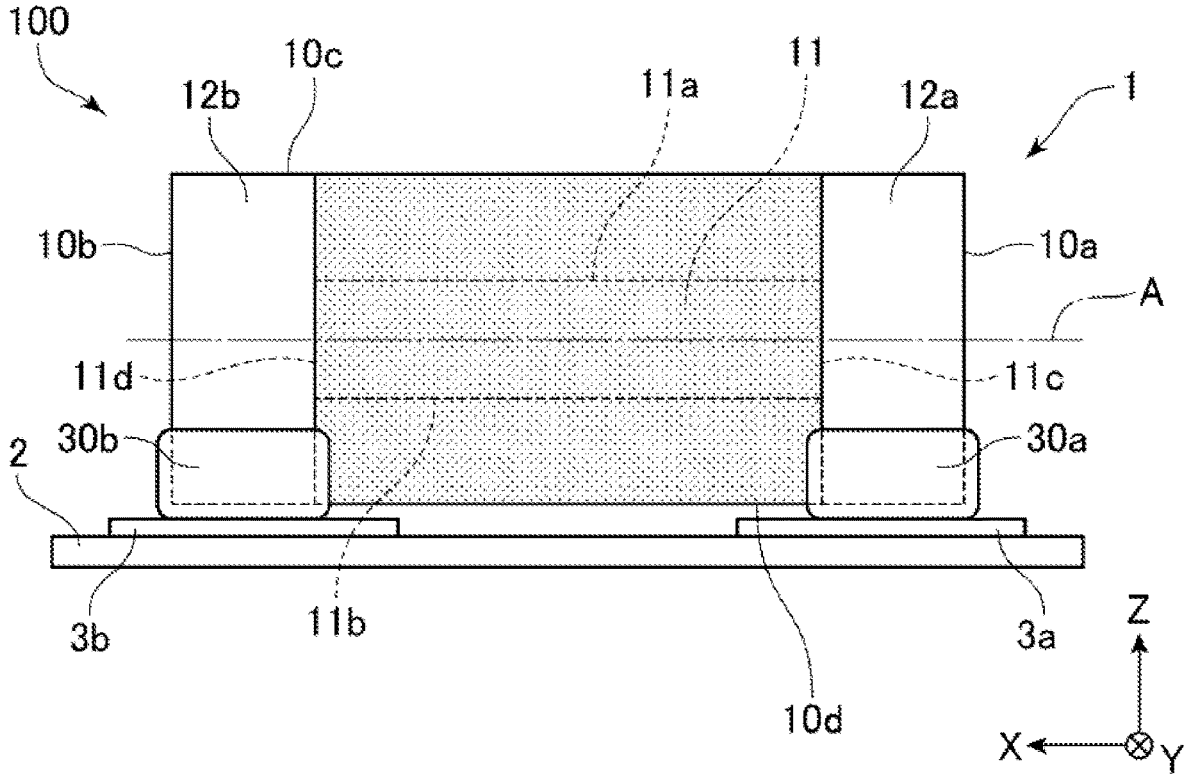
FIG. 2 is a front view of the coil component shown in FIG. 1.
Figure 3:
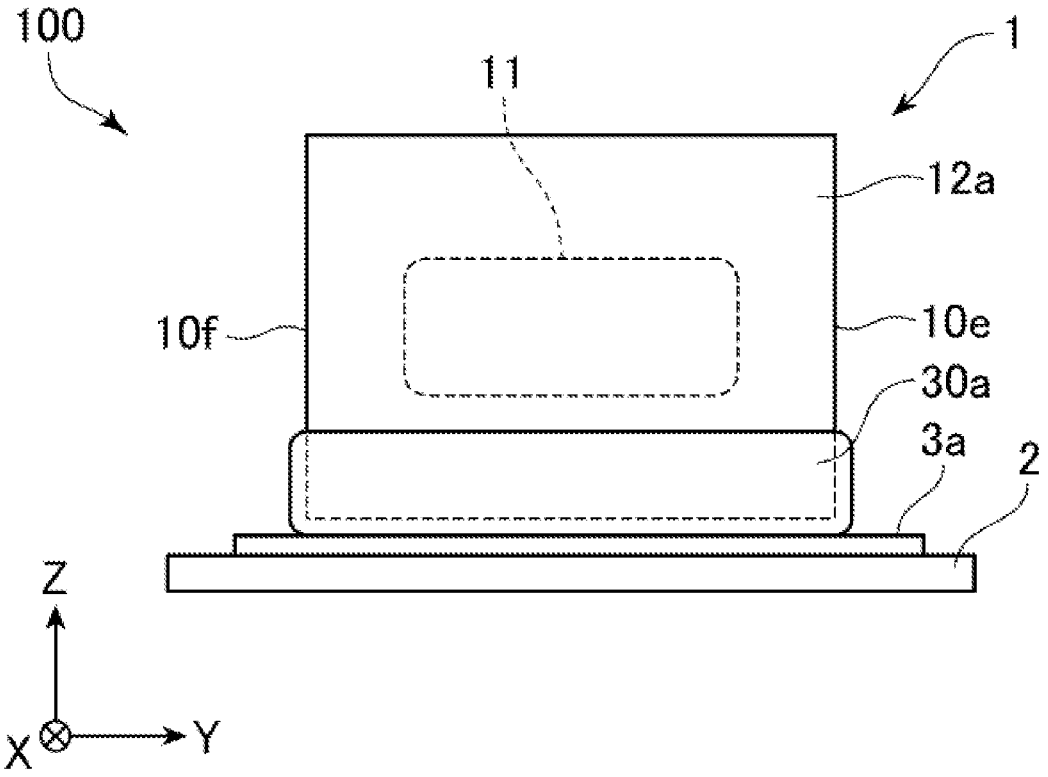
FIG. 3 is a right side view of the coil component shown in FIG. 1.
Figure 4:
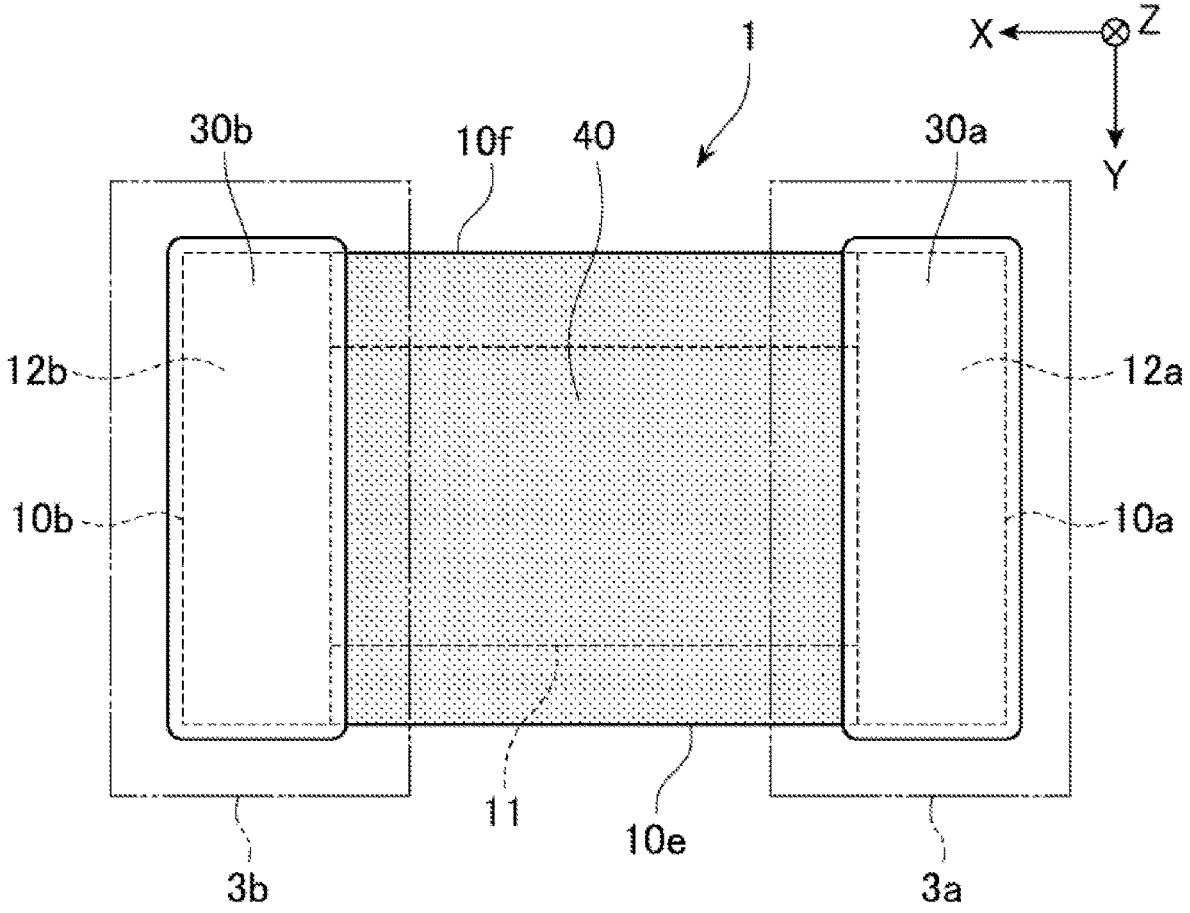
FIG. 4 is a bottom view of the coil component shown in FIG. 1.
Figure 5:
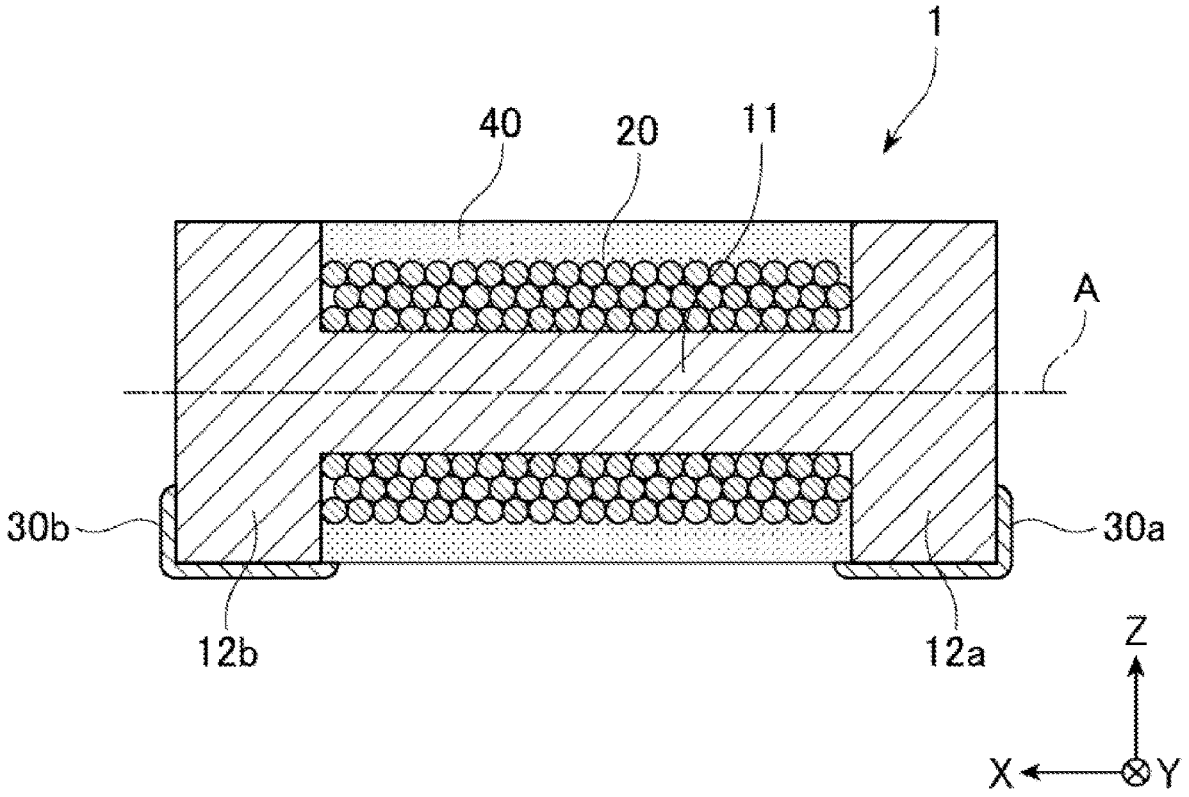
FIG. 5 is a sectional view of the coil component shown in FIG. 4 cut along the line I-I.
Figure 6:
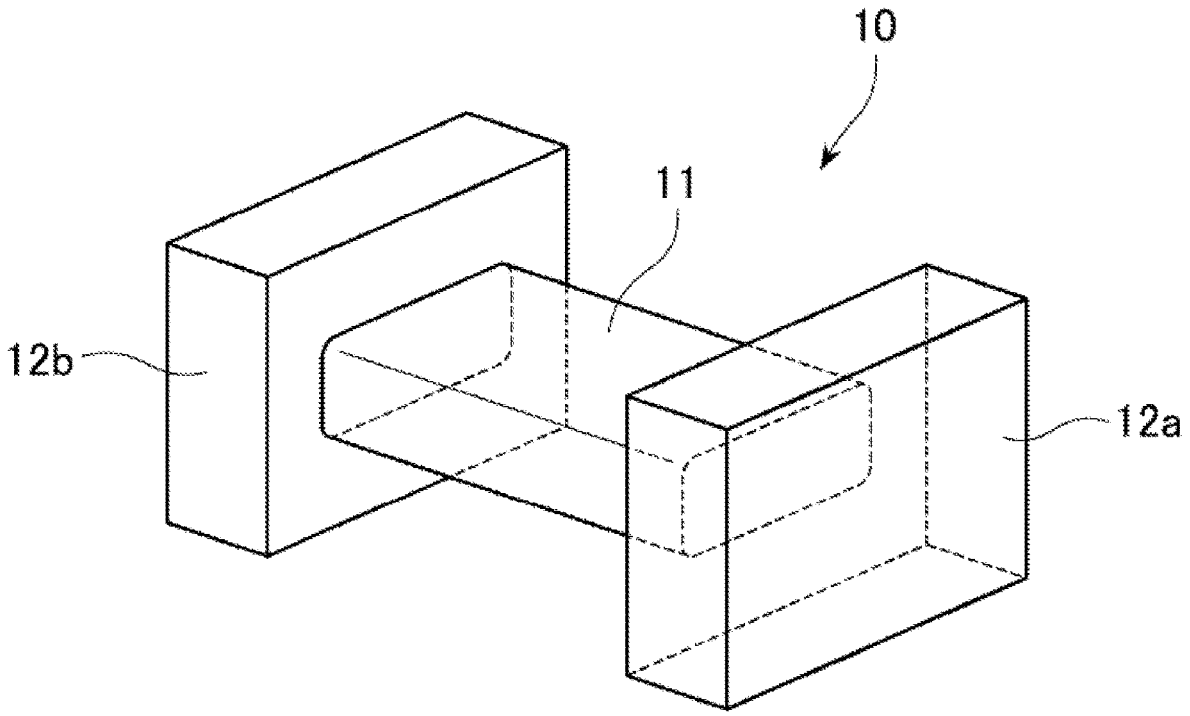
FIG. 6 is a perspective view of a drum core shown in FIG. 1.

FIG. 1 is a perspective view of a coil component 1 according to one embodiment of the invention, FIG. 2 is a front view of the coil component, FIG. 3 is a right side view of the coil component 1, FIG. 4 is a bottom view of the coil component 1, FIG. 5 is a sectional view of the coil component 1 along the line I-I, and FIG. 6 is a perspective view of a core of the coil component 1.

The coil component 1 of the embodiment shown is mounted to a circuit substrate 2 via a first land portion 3*a* and a second land portion 3*b*. The coil component 1 is, for example, an inductor used to eliminate noise in an electronic circuit. The coil component 1 may be a power inductor built in a power supply line or an inductor used in a signal line.

FIG. 1 shows an X direction, a Y direction, and a Z direction orthogonal to one another. Herein, orientations and arrangements of constituent members of the coil component 1 may be described based on the X direction, the Y direction, and the Z direction shown in FIG. 1. More specifically, the direction in which the axis A of the winding core 11 extends is designated as the X direction, and the direction perpendicular to the axis A of the winding core 11 and parallel to a mounting surface of a circuit substrate 2 is designated as the Y direction. Furthermore, a direction orthogonal to the X direction and the Y direction is defined as the Z direction. Herein, the X direction may be referred to as a width direction of the coil component 1, the Y direction may be referred to as a length direction of the coil component 1, and the Z direction may be referred to as a height direction of the coil component 1.

The coil component 1 according to one embodiment of the present invention has a rectangular parallelepiped shape. The coil component 1 has a first end surface 1*a*, a second end surface 1*b*, a first principal surface 1*c* (a top surface 1*c*), a second principal surface 1*d* (a bottom surface 1*d*), a first side surface 1*e*, and a second side surface 1*f*. More specifically, the first end surface 1*a* is an end surface of the coil component 1 in an X-axis negative direction, the second end surface 1*b* is an end surface of the coil component 1 in an X-axis positive direction, the first principal surface 1*c* is an end surface of the coil component 1 in a Z-axis positive direction, the second principal surface 1*d* is an end surface of the coil component 1 in a Z-axis negative direction, the first side surface 1*e* is an end surface of the coil component 1 in a Y-axis positive direction, and the second side surface 1*f* is an end surface of the coil component 1 in a Y-axis negative direction.

As shown, the coil component 1 includes a drum core 10 made of a ferrite material, a winding 20, a first external electrode 30*a*, a second external electrode 30*b*, and a resin portion 40.

The drum core 10 includes the winding core 11 extending in a direction parallel to the mounting surface of the circuit substrate 2, a flange 12*a* having a rectangular parallelepiped shape and provided on one end of the winding core 11, and a flange 12*b* having a rectangular parallelepiped shape and provided on the other end of the winding core 11. Accordingly, the winding core 11 couples the flange 12*a* and the flange 12*b*. The flange 12*a* and the flange 12*b* are arranged such that the inside surfaces of these flanges are opposed to each other.

The drum core 10 has a first end surface 10*a*, a second end surface 10*b*, a first principal surface 10*c* (top surface 10*c*), a second principal surface 10*d* (bottom surface 10*d*), a first side surface 10*e*, and a second side surface 10*f*.

In the embodiment shown, the winding core 11 is in a substantially quadrangular prism shape. The winding core 11 can assume any shape suitable for winding the winding 20 thereon. For example, the winding core 11 may be formed in a polygonal prism shape such as a triangular prism shape, a pentagonal prism shape, or a hexagonal prism shape, a columnar shape, an elliptical columnar shape, or a truncated cone shape.

The drum core 10 is a ferrite sintered body obtained by sintering the ferrite material. The ferrite material for the drum core 10 includes, for example, oxides containing $Fe_2O_3$, ZnO, CuO, and NiO as main components and $Bi_2O_3$ as a subcomponent. More specifically, the ferrite material for the drum core 10 contains 49.3 mol % of $Fe_2O_3$, 23.1 mol % of ZnO, 6.6 mol % of CuO, and 21 mol % of $NiO_2$ as the main components, and 0.03 to 0.1 wt % of $Bi_2O_3$ as the subcomponent. The content ratio of each component can be adequately changed. For example, the content ratio of $Bi_2O_3$ may be 0.05 to 0.075 wt %.

The drum core 10 is manufactured by a conventional method based on the above ferrite material. The following describes an exemplary method of fabricating the drum core. Powders of $Fe_2O_3$, ZnO, CuO, and NiO, which are the main components, are mixed, and this mixed powder is calcined at about 850° C. Next, the calcined mixed powder is crushed by a wet crusher to obtain a ferrite powder having an average particle size of 2 μm. The ferrite powder is then mixed with water to prepare a slurry, and $Bi_2O_3$ powder is added to the slurry. The amount of $Bi_2O_3$ powder added is, for example, 0.03 to 0.1 wt % as described above. Subsequently, the slurry to which the $Bi_2O_3$ powder has been added is stirred with a Disper mixer at a rotation speed of 500 to 1000 rpm for 5 minutes or more. A binder is added to the slurry after stirring to form a granulated product. Next, a compact having the shape of the drum core 10 is obtained by compression compacting the granulated product. The compact is fired in the atmosphere at about 1050° C. to produce the drum core 10. The main components of the ferrite material for the drum core 10 are not limited to those described above. The content ratio of the oxides contained as the main components can be adequately changed. Further, various parameters in the manufacturing process can be adequately changed.

Wire of the winding 20 is wound around the winding core 11. The winding 20 is a conductor wire made of a metal material having excellent electrical conductivity covered with an insulation coating therearound. As the metal material used for the winding 20, there can be used, for example, one or more from among Cu (copper), Al (aluminum), Ni (nickel), and Ag (silver) or an alloy containing any of these metals.

The external electrode 30*a* is provided on the flange 12*a*, and the external electrode 30*b* is provided on the flange 12*b*. The shape and arrangement of the external electrode 30*a* and the external electrode 30*b* shown are merely illustrative, and the external electrode 30*a* and the external electrode 30*b* can be variously shaped and arranged.

One end of the winding 20 is electrically connected to the external electrode 30*a*, while the other end of the winding 20 is electrically connected to the external electrode 30*b*.

The resin portion 40 is formed by filling a resin between the flange 12*a* and the flange 12*b*. The resin portion 40 covers at least a part of the winding 20. For example, the resin portion 40 may cover only the upper surface of the winding 20, so as to ensure or increase the fixation in mounting. The resin portion 40 is composed of, for example, a resin or a resin containing a filler. The resin portion 40 is made of any resin material that is used to cover a winding in a wire-wound coil component. The filler is composed of either a magnetic material or a non-magnetic material. The filler is made of ferrite powder, magnetic metal particles, alumina particles, or silica particles so as to lower the coefficient of linear expansion and increase the mechanism strength of the resin portion 40.

Figure 7:
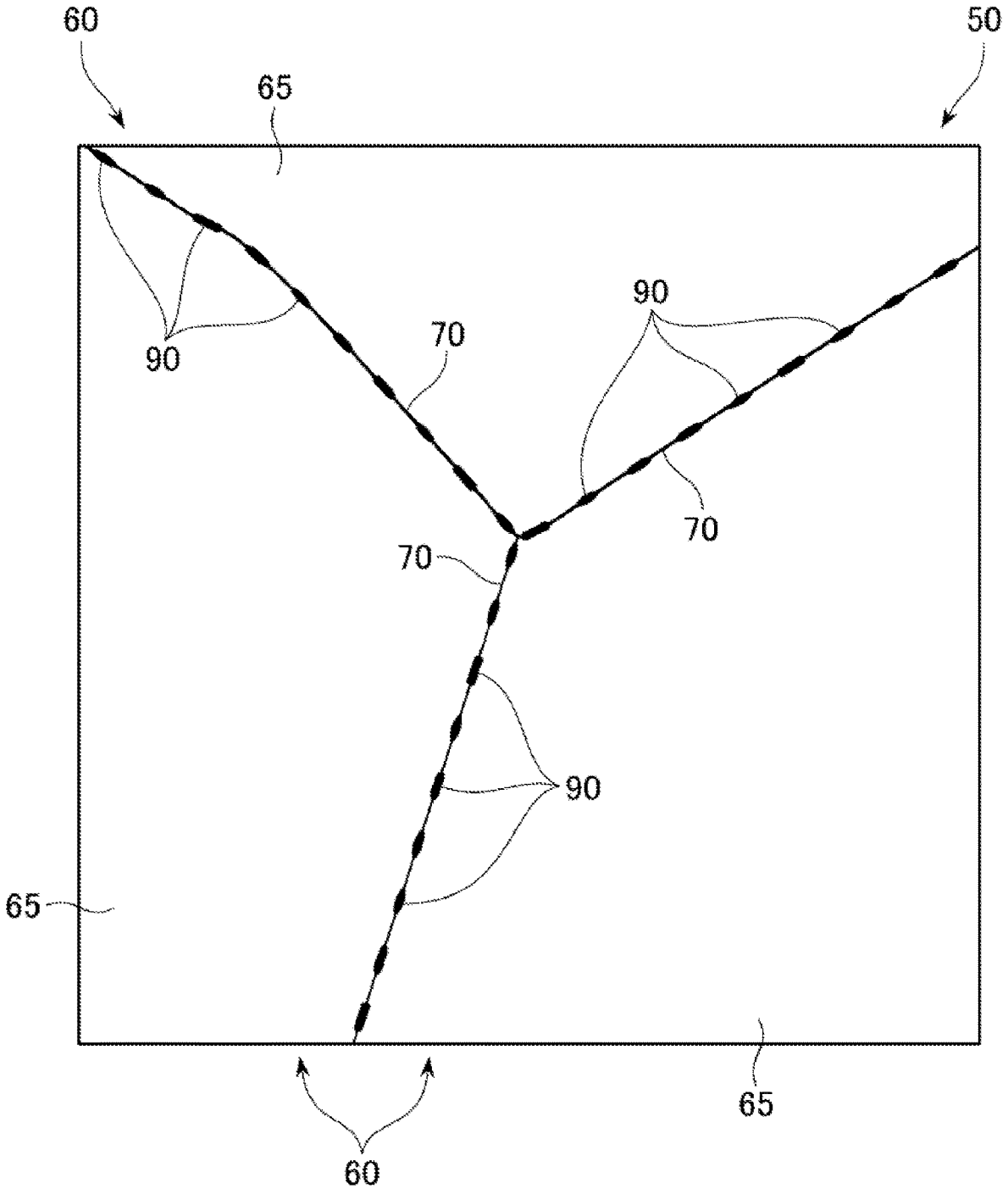
FIG. 7 is a schematic image of a cross section of a magnetic base body according to the embodiment observed with a scanning transmission electron microscope.

Next, the crystal structure in the drum core 10 will be described with reference to FIG. 7. FIG. 7 is a schematic STEM image of a cross section of the drum core 10 according to the embodiment of the invention observed with a scanning transmission electron microscope (STEM). FIG. 7 shows the STEM image of the section of the drum core 10 in a 1.3 μm×1.3 μm region 50. For analysis by EDS mapping described below, the region 50 is selected such that a grain boundary is contained within the field of view. The region 50 is selected so as to include, for example, a triple point of crystal grains. As shown, the region 50 includes three ferrite crystal grains 60 and grain boundaries 70 between these crystal grains 60.

As shown in FIG. 7, at the grain boundaries 70 of the ferrite crystal grains 60, a composition containing Bi as the main component is segregated and the composition is segregated in a plurality of regions. The composition mainly containing Bi segregated at the grain boundaries 70 of the ferrite crystal grains 60 is herein referred to as a "Bi segregated region". In FIG. 7, the Bi segregated region is indicated by the reference numeral 90. At the grain boundary 70, the Bi segregated regions 90 are not segregated in a sheet form but distributed in an island pattern. In other words, along the grain boundary 70, a plurality of Bi segregated regions 90 exist apart from each other. FIG. 7 is an example of the image obtained by observing the section of the drum core 10 with the STEM. However, even when observing another section of the drum core 10, the grain boundaries 70 include the Bi segregated regions 90 that are situated apart from each other.

The fact that the Bi segregated regions included in the grain boundary 70 is distributed in the island pattern instead of the sheet form can be confirmed based on mapping data of Bi obtained by EDS mapping as described below. Energy dispersive X-ray analysis (EDS) is first performed on the STEM image of the region 50 to obtain mapping data of Bi. Next, the mapping data of Bi is reconstructed along a plurality of (ten in this example) scanning lines SL1 to SL10 that cross the grain boundary 70. The mapping data reconstructed along the scanning lines SL1 to SL10 provides a line profile for each of the scanning lines SL1 to SL10. The length of the scanning lines SL1 to SL10 is, for example, 100 nm respectively, and the interval (scanning pitch) of the scanning lines SL1 to SL10 is, for example, 20 nm. The scanning lines SL1 to SL10 are set at equal intervals, for example. The number of scanning lines, the length, and the scanning pitch for obtaining the line profiles can be adequately changed.

Figure 9:
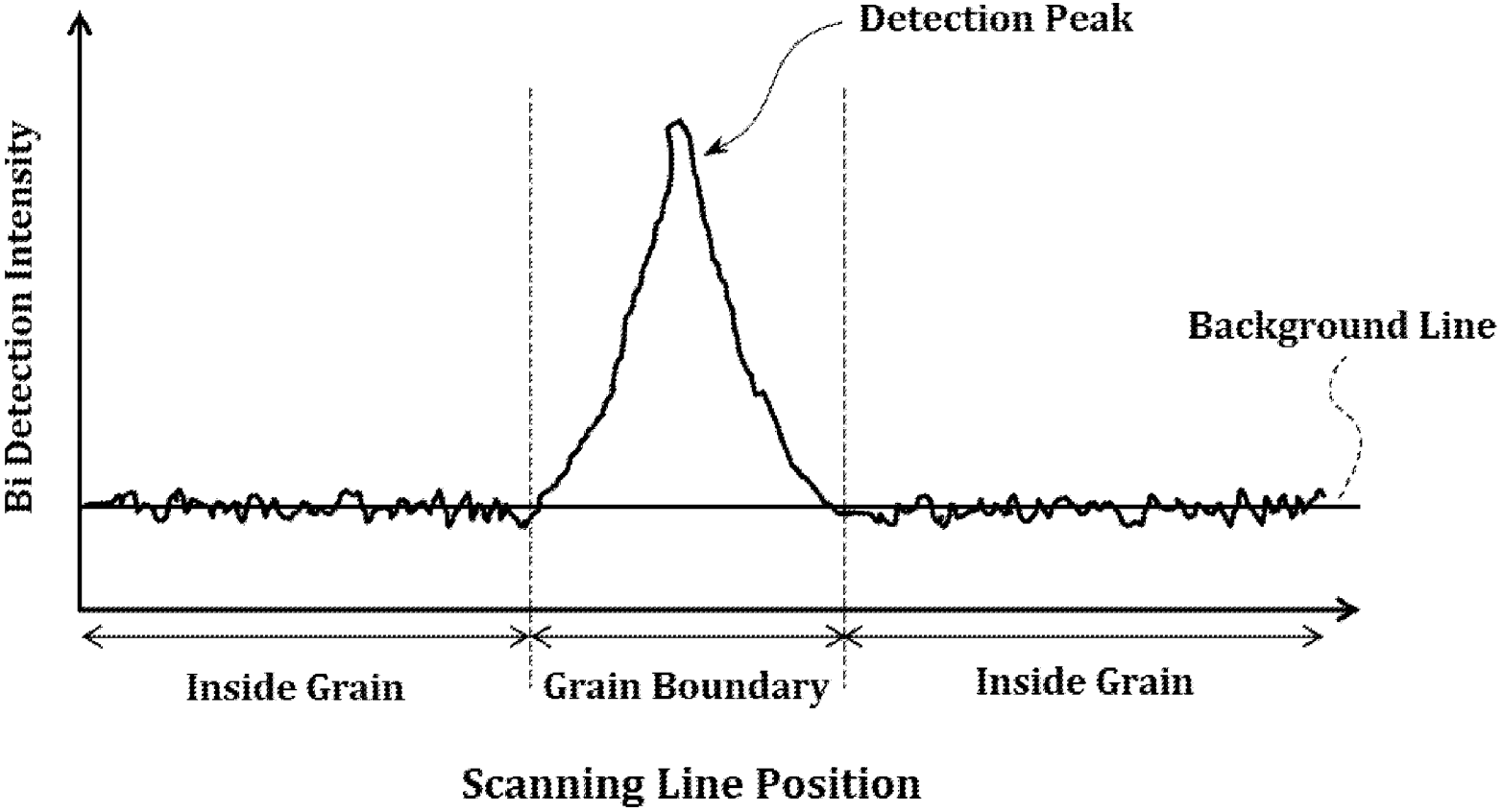
FIG. 9 is an example of a first line profile obtained by the EDS mapping method.
Figure 10:
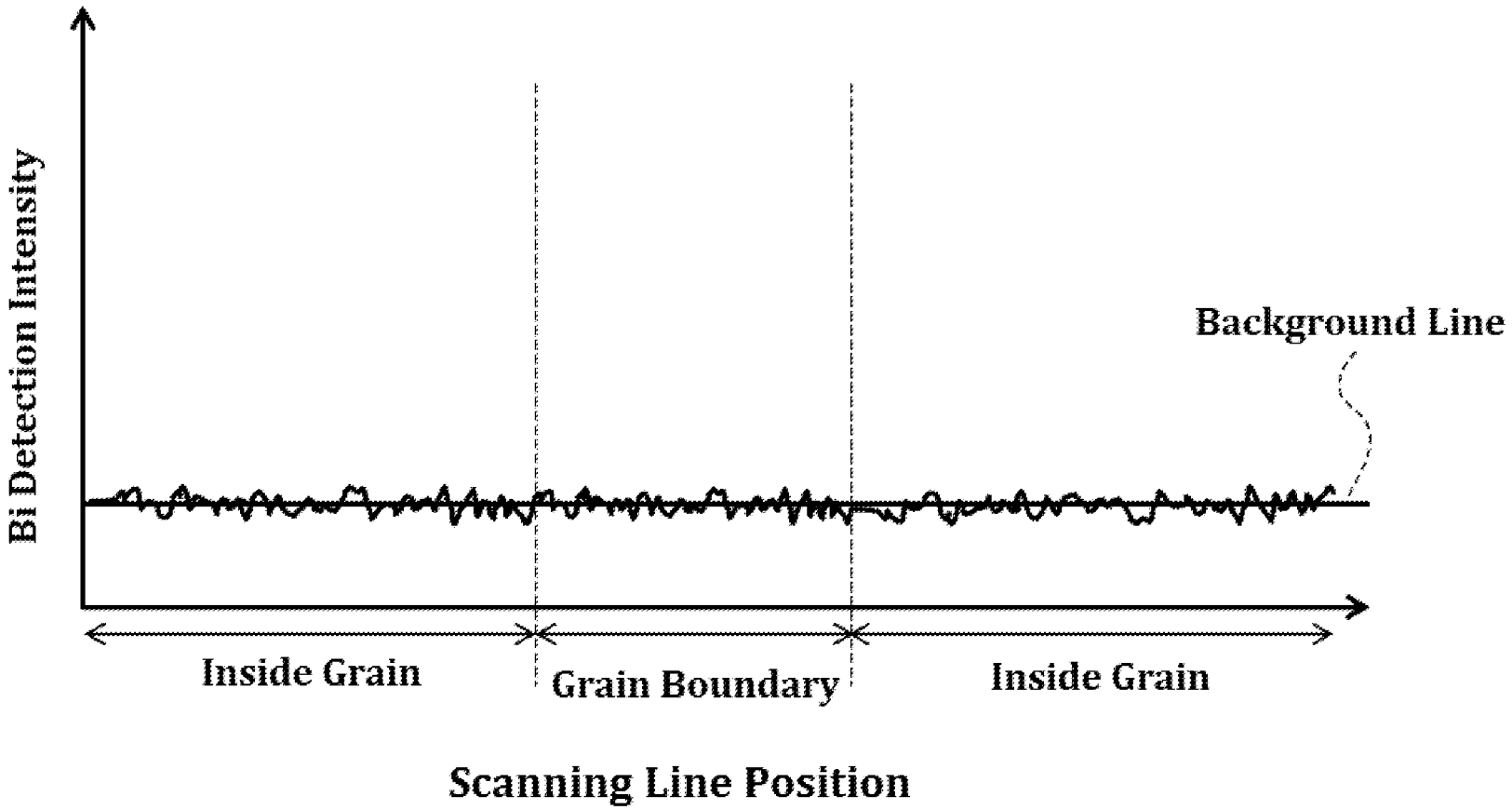
FIG. 10 is an example of a second line profile obtained by the EDS mapping method.

As described above, the line profile is obtained by reconstructing the mapping data of Bi along the scanning line. An example of the line profiles are shown in FIGS. 9 and 10. As illustrated, the line profile is represented as a graph of the count value of Bi at each detection position on the scan line. FIG. 9 shows a line profile obtained by reconstructing the mapping data of Bi along the scan line SL1, and FIG. 10 shows a line profile obtained by reconstructing the mapping data of Bi along the scanning line SL2. In the graphs of FIGS. 9 and 10, the horizontal axis represents detection positions on each scanning line, and the vertical axis represents the count number of Bi at each detection position. The count number of Bi represents a Bi detection intensity which is the detection intensity of Bi.

Figure 8:
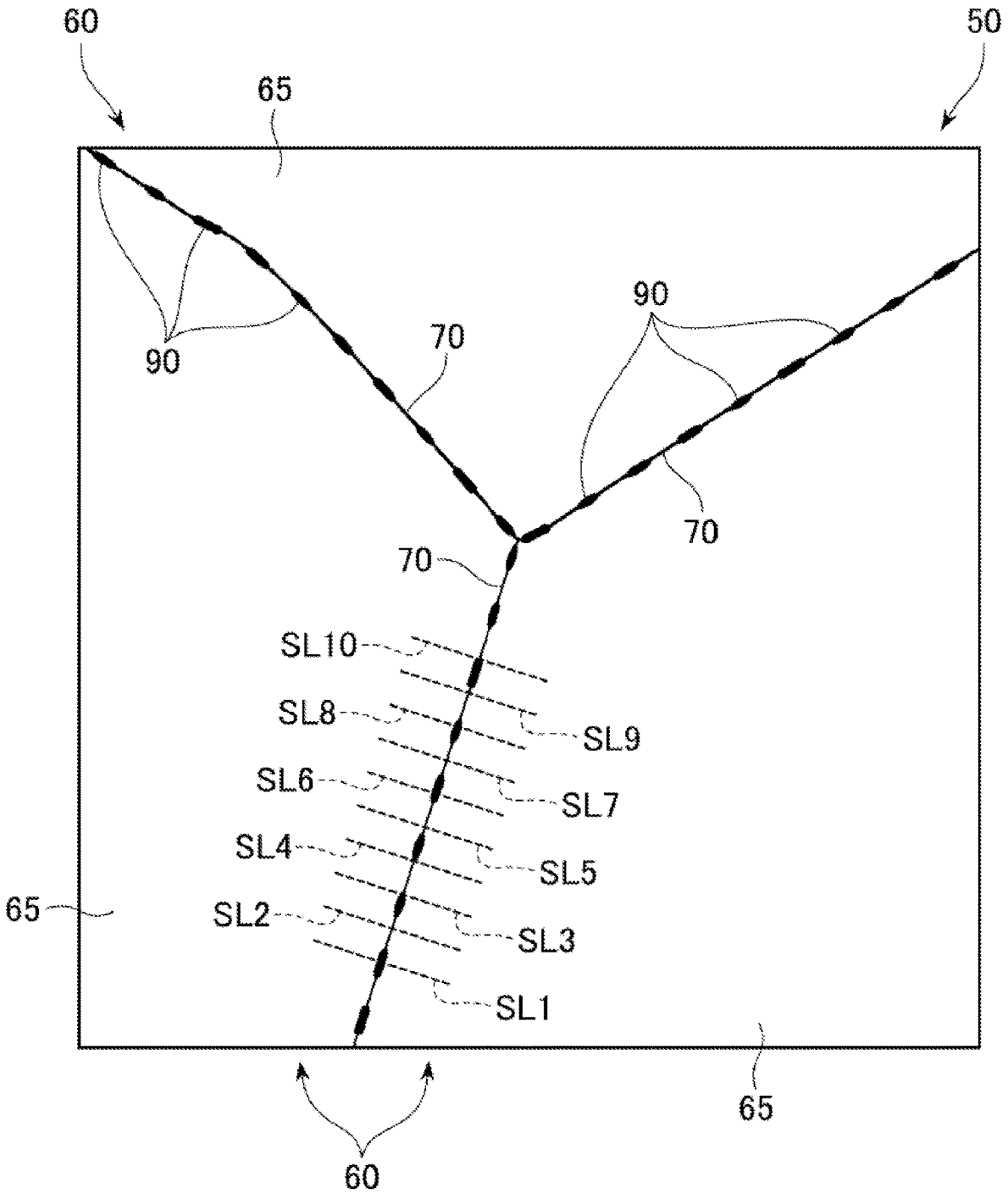
FIG. 8 is a schematic diagram for explaining a method of performing EDS mapping on the image of FIG. 7.

As shown in FIG. 8, the scanning line SL1 is set at a position where it passes through one of the Bi segregated regions 90 existing separately from each other. Therefore, the line profile of the scanning line SL1 shown in FIG. 9 includes a detection peak of Bi at the detection position corresponding to the grain boundary 70. Since the scanning lines SL3, SL6, SL8, and SL10 are also set at positions where they pass through the Bi segregated regions 90 similarly to the scanning line SL1, line profiles of the scanning lines SL3, SL6, SL8, and SL10 each have a detection peak of Bi at the detection position corresponding to the grain boundary 70 similarly to the line profile of the scanning line SL1.

Whereas the scanning line SL2 is set at a position where the line does not pass the Bi segregated region 90. Therefore, the line profile of the scanning line SL2 shown in FIG. 10 does not have a detection peak of Bi at the detection position corresponding to the grain boundary 70. Similarly to the scanning line SL2, the scanning lines SL4, SL5, SL7, and SL9 are also set at positions where they do not pass through the Bi segregated region 90 so that line profiles of the scanning lines SL4, SL5, SL7, and SL9 do not have a detection peak of Bi at the detection positions corresponding to the grain boundary 70.

Most of Bi segregates at the grain boundaries, but a small amount of Bi may diffuse into the grains. When Bi is diffused in the grains, mapping data of Bi reconstructed along each scanning line has a certain count even at detection positions corresponding to inside the grains. Elemental Bi other than the Bi segregated at the grain boundaries is reflected as background detection values in the line profile, as shown in FIGS. 9 and 10. When a scanning line passes through the Bi segregated region 90 at the grain boundary, the Bi detection intensity significantly higher than the Bi detection intensity of the background is obtained at the detection position corresponding to the grain boundary in the line profile of the scanning line. For a given line profile, when a ratio of the maximum value of the Bi detection intensity at the detection position corresponding to the grain boundary 70 to a background detection intensity, which is the average Bi detection intensity in the grains, is equal to or higher than a reference ratio, it is determined that this line profile includes a detection peak of Bi at the grain boundary. For a given line profile, whereas when a ratio of the maximum value of the Bi detection intensity at the detection position corresponding to the grain boundary 70 to the background detection intensity is less than the reference ratio, it is determined that this line profile does not include a detection peak. This reference ratio is, for example, 1.2 (times). The reference ratio can be changed as appropriate. The background detection intensity may be the average of the count values of Bi at a plurality of detection positions of the line profile corresponding to the insides of the grains. Assuming that the length of the scanning line is 100 nm and a region situated 40 to 60 nm from one end of the scanning line is a grain boundary, the average of the count values of Bi at six positions, 6 nm, 10 nm, 20 nm, 30 nm, 70 nm, 80 nm and 90 nm from the end of the scanning line, may be used as the background detection intensity. A line profile including a detection peak of Bi at a detection position corresponding to a grain boundary may be herein referred to as a "first line profile," and a line profile that does not include a detection peak of Bi at a detection position corresponding to a grain boundary may be herein referred to as a "second line profile."

When a foreign substance other than the Bi segregated in the region 90 is present at the grain boundary 70, a line profile of the scanning line passing through the foreign substance does not have a detection peak of Bi at the grain boundary, similarly to the line profile shown in FIG. 10. In order to prevent such an erroneous determination caused by foreign substance, the scanning line is set at a position where the line does not pass through the foreign substance. The position of the foreign substance can be specified, for example, based on the mapping data for element Fe. In the mapping data of the Fe, if there is a portion where the count value of Fe sharply drops compared to that of the surrounding area, it is determined that the foreign substance exists in the portion.

In the example shown in FIG. 8, the line profiles of the ten scanning lines SL1 to SL10 include two or more first line profiles and two or more second line profiles. The number of the first line profiles may be one or two or more. The number of the second line profiles is two or more. From the fact that two or more second line profiles exist at the grain boundary 70, it is understood that the Bi segregated region 90 is separated from other Bi segregated regions.

In the example shown in FIG. 8, the scanning line SL6 that passes through the Bi segregated region 90 (that is, the scanning line corresponding to the first line profile) is situated between the two scanning lines SL5 and SL7 that do not pass through the Bi segregated regions (that is, two scanning lines corresponding to the second line profile). The scanning line SL6 that passes through the Bi segregated region 90 is disposed between the scanning lines SL5 and SL7 that do not pass through the Bi segregated region 90. Therefore it can be found that the Bi segregated region 90 is located at a position of the grain boundary 70 that intersects with the scanning line SL6 and the Bi segregated regions 90 do not exist at positions of the grain boundary 70 that intersect with the scanning lines SL5 and SL7 adjacent to the scanning line SL6. That is, it can be confirmed that, along the grain boundary 70, no other Bi segregated regions exist around the Bi segregated region 90 through which the scanning line SL6 passes. Similarly, since the scanning line SL8 passing through the Bi segregated region 90 is situated between the scanning lines SL7 and SL9 that do not pass through the Bi segregated regions 90, it can be confirmed that, along the grain boundary 70, no Bi segregated regions exist in the area around the Bi segregated region 90 through which the scanning line SL8 passes. In this way, it is possible to confirm that the Bi segregated region 90 is separated from the other Bi segregated regions 90 at the grain boundary 70.

Advantageous effects of the coil component 1 according to the embodiment will now be described.

In the drum core 10 according to the embodiment of the invention, the Bi segregated region 90 exists at the grain boundary 70 of the ferrite crystal grains. Since the Bi segregated regions 90 serves as a stress buffer against shock due to heat, etc., it is possible to reduce the chance of cracks in the drum core 10 due to thermal shock as compared with the case where there is no Bi segregated region 90 at the grain boundary 70. The Bi segregated region has a function of preventing the generation and expansion of cracks. However when the Bi segregated region is formed in a layer or film-like manner at the grain boundary 70, it hinders the direct binding of crystal grains. Further, the strength of the layer or film of the Bi segregated compound is relatively weak so that the layer of the Bi segregated compound easily comes off or is broken in layers or films. This may cause reduction in the mechanical strength of the drum core 10 against an external force. As described above, in the conventional ferrite core, the stress relaxation layer made of Bi oxide or the stress relaxation layer containing Bi oxide is formed as a continuous layer or film in which crystal grains therein do not contact each other at the grain boundary of the crystal grains. Whereas in the drum core 10 according to the embodiment of the invention, the plurality of Bi segregated regions 90 are provided along the grain boundary 70 such that they are separated from each other. Since the plurality of Bi segregated regions 90 are situated apart from each other in the drum core 10, direct bindings of particles are increased compared to the conventional ferrite core in which the stress relaxation layer is formed at the grain boundary in the form of a layer or a film. Further it is possible to prevent separation/breakage inside the Bi segregated regions from being propagated and to limit it to a local phenomenon, so that it is possible prevent a decrease in the mechanical strength against an external force. The mechanical strength against an external force is represented by, for example, the deflecting strength or bending strength that can be measured by a standardized method. Whether the Bi segregated regions are separated or exit in the form of a layer or a film can be determined by reading the line profile obtained by reconstructing the mapping data of Bi acquired through the EDS mapping as described above.

As discussed above, the drum core 10 according to the embodiment of the invention can reduce the chance of cracks due to thermal shock and can prevent the decrease in mechanical strength against an external force.

The drum core 10 according to the embodiment contains 0.03 to 0.1 wt %, more preferably 0.05 to 0.075 wt % of Bi in terms of oxide. Since the conventional ferrite material excessively contains Bi and other subcomponents, it is considered that Bi oxide is formed in a layer or film form at the grain boundary. Whereas in the above-described embodiment, the upper limit of the Bi content ratio is set to 0.1 wt % in terms of Bi oxide with respect to the total amount of the main components, so that Bi is segregated into an island pattern instead of in a form of layer or film. In this way, it is possible to prevent decrease in the mechanical strength due to the presence of a film or layer of the segregated compound at the grain boundary.

When the drum core 10 according to the embodiment is fabricated, $Bi_2O_3$ powder is added to a slurry of ferrite powder prepared by crushing ferrite with a wet crusher. The $Bi_2O_3$ powder added to the slurry is not crushed by a wet crusher. The average particle size of the $Bi_2O_3$ powder is, for example, in the range of 1 to 5 μm. The average particle size of the $Bi_2O_3$ powder added to the slurry is selected to be the same as or larger than the average particle size of the crushed ferrite powder. The average particle size of the crushed ferrite powder is, for example, in the range of 1 to 3 μm. The average particle size of the $Bi_2O_3$ powder and the crushed ferrite powder is not particularly limited to the above range. For example, the average particle size of the $Bi_2O_3$ powder and the average particle size of the crushed ferrite powder may be adequately set as long as the average particle size of the $Bi_2O_3$ powder is equal to or larger than the average particle size of the crushed ferrite powder, for example, may be in the range of 0.1 to 20 μm. A particle size distribution of the $Bi_2O_3$ powder may be obtained and the 50% value (D50) of the obtained particle size distribution can be used as the average particle size of the $Bi_2O_3$ powder. The average particle size of the ferrite powder may be similarly determined. When fabricating the drum core 10, the average particle size of the $Bi_2O_3$ powder is first selected, and ferrite crushing conditions are then selected such that the average particle size of the crushed ferrite powder becomes smaller than the average particle size of the $Bi_2O_3$ powder. In this way, the average particle size of the $Bi_2O_3$ powder added to the slurry can be selected to be the same as or larger than the average particle size of the crushed ferrite powder. By setting the average particle size of the $Bi_2O_3$ powder to be same as or larger than the average particle size of the crushed ferrite powder, a plurality of Bi segregated regions can be easily provided at the grain boundaries 70 even if the added amount of $Bi_2O_3$ powder is small.

The dimensions, materials, and arrangements of the constituent elements described herein are not limited to those explicitly described for the embodiments, and these constituent elements can be modified to have any dimensions, materials, and arrangements within the scope of the present invention. Furthermore, constituent elements not explicitly described herein can also be added to the described embodiments, and it is also possible to omit some of the constituent elements described for the embodiments.

What is claimed is:

1. A coil component comprising:

a core including a plurality of ferrite crystal grains and a plurality of Bi segregated regions situated at a grain boundary of the plurality of ferrite crystal grains; and a winding wound around the core, wherein a plurality of line profiles obtained by detecting a content of Bi along a plurality of scanning lines intersecting with the grain boundary include at least one first line profile that has a detection peak of Bi at the grain boundary and two or more second line profiles that have no detection peak of Bi; and wherein the plurality of scanning lines are set at equal intervals.

2. The coil component of claim 1, wherein the plurality of scanning lines includes at least one first scanning line corresponding to the at least one first line profile and two second scanning lines corresponding to the two or more second line profiles, and at least one of the at least one first scanning line is disposed between the two second scanning lines.

3. The coil component of claim 1, wherein the core contains 0.03 to 0.1 wt % of Bi in terms of oxide.

4. The coil component of claim 3, wherein the core contains 0.05 to 0.075 wt % of Bi in terms of oxide.

5. The coil component of claim 1 wherein the plurality of Bi segregated regions are separated from each other.

6. A circuit substrate comprising the coil component of claim 1.

7. An electronic device comprising the circuit substrate according to claim 6.

* * * * *